US012605022B2

(12) United States Patent
Perry et al.

(10) Patent No.: US 12,605,022 B2
(45) Date of Patent: Apr. 21, 2026

(54) BRUSHROLL FOR VACUUM CLEANER

(71) Applicant: BISSELL INC., Grand Rapids, MI (US)

(72) Inventors: Joseph P. Perry, Comstock Park, MI (US); Jayson Christopher Achram, Grand Rapids, MI (US); Tyler Tucker Grab, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 355 days.

(21) Appl. No.: 18/134,811

(22) Filed: Apr. 14, 2023

(65) Prior Publication Data

US 2023/0355055 A1 Nov. 9, 2023

Related U.S. Application Data

(60) Provisional application No. 63/337,751, filed on May 3, 2022.

(51) Int. Cl.

| | |
|---|---|
| ***A47L 9/04*** | (2006.01) |
| ***A46B 9/02*** | (2006.01) |
| ***A46B 9/06*** | (2006.01) |
| ***A46B 9/12*** | (2006.01) |
| ***A46B 13/00*** | (2006.01) |
| ***A46B 13/02*** | (2006.01) |

(52) U.S. Cl.

CPC ..... *A47L 9/0477* (2013.01); *A46B 9/026* (2013.01); *A46B 9/06* (2013.01); *A46B 9/12* (2013.01); *A46B 13/001* (2013.01); *A46B 13/02* (2013.01); *A46B 2200/3033* (2013.01)

(58) Field of Classification Search

CPC ..... A46B 9/04; A46B 13/02; A47L 11/28

See application file for complete search history.

(56) References Cited

U.S. PATENT DOCUMENTS

| | | | | |
|---|---|---|---|---|
| 1,898,318 | A * | 2/1933 | Smith | A47L 11/33 15/48 |
| 2,181,455 | A * | 11/1939 | Gussack | A47L 11/4025 D32/38 |
| 3,646,629 | A * | 3/1972 | Bienek | E04G 1/12 15/48 |
| 4,802,254 | A * | 2/1989 | Lahndorff | A47L 9/04 15/179 |
| 8,443,477 | B2 * | 5/2013 | Jang | A47L 11/24 15/43 |
| 10,602,895 | B2 | 3/2020 | Kasper, Jr. et al. | |
| 10,912,435 | B2 * | 2/2021 | Kelsey | A47L 9/0488 |
| 10,925,447 | B2 | 2/2021 | Der Marderosian et al. | |

(Continued)

FOREIGN PATENT DOCUMENTS

KR 101055961 B1 8/2011

OTHER PUBLICATIONS

European Patent Office, Extended European Search Report re Corresponding Application No. 23170935.3 - 1016, Jun. 19, 2023, 9 pages, Munich, Germany.

*Primary Examiner* — Michael D Jennings

(74) *Attorney, Agent, or Firm* — McGarry Bair PC

(57) ABSTRACT

A vacuum cleaner includes a base having an agitator chamber and a suction nozzle opening in fluid communication with the agitator chamber. A brushroll is positioned within the agitator chamber for rotational movement. The brushroll includes a brush dowel provided with a plurality of bristles. The brush dowel has a plurality of ribs.

17 Claims, 12 Drawing Sheets

(56) References Cited

U.S. PATENT DOCUMENTS

| | | | | |
|---|---|---|---|---|
| 2007/0271726 | A1* | 11/2007 | Park | A47L 9/04 15/387 |
| 2014/0053362 | A1* | 2/2014 | Hosterman | A47L 9/0477 15/256.52 |
| 2015/0374187 | A1* | 12/2015 | Denhof | A47L 9/02 15/353 |
| 2016/0345792 | A1* | 12/2016 | Herron | A47L 9/0477 |
| 2017/0127896 | A1* | 5/2017 | Carter | A47L 5/30 |
| 2017/0280957 | A1* | 10/2017 | Jeong | A47L 9/0411 |
| 2017/0311767 | A1* | 11/2017 | Fang | A46B 13/02 |
| 2018/0184862 | A1* | 7/2018 | Choi | A47L 9/0466 |
| 2020/0121144 | A1* | 4/2020 | Gacin | A47L 9/0613 |
| 2021/0235946 | A1* | 8/2021 | Kelsey | A46B 13/02 |
| 2022/0071459 | A1* | 3/2022 | Gacin | A46B 13/02 |

* cited by examiner

BRUSHROLL FOR VACUUM CLEANER

CROSS-REFERENCE TO RELATED APPLICATION(S)

This application claims the benefit of U.S. Provisional Patent Application No. 63/337,751, filed May 3, 2022, which is incorporated herein by reference in its entirety.

BACKGROUND

Vacuum cleaners can include an agitator or agitator assembly for agitating debris on a surface to be cleaned so that the debris is more easily ingested into the vacuum cleaner. In some cases, the agitator comprises a brushroll that rotates within a base or floor nozzle. Such brushrolls can be rotatably driven by a motor, a turbine fan or a mechanical gear train, for example. Brushrolls typically have a generally cylindrical dowel with multiple bristle tufts extending radially from the dowel.

BRIEF DESCRIPTION

According to one aspect of the present disclosure, a vacuum cleaner comprises a base comprising an agitator chamber and a suction nozzle opening in fluid communication with the agitator chamber, a brushroll positioned within the agitator chamber for rotational movement, the brushroll comprising a brush dowel having a plurality of ribs and provided with a plurality of bristles, and a comb assembly provided within the agitator chamber, the comb assembly circumscribing at least a portion of the brushroll and comprising a plurality of teeth that radially extend between a portion of the ribs of the brushroll.

Another aspect of the present disclosure relates to an agitator assembly for a surface cleaner, the agitator assembly comprising a housing at least partially defining an agitator chamber and a suction nozzle opening in fluid communication with the agitator chamber, a brushroll positioned within the agitator chamber for rotational movement, the brushroll comprising a brush dowel having a plurality of ribs and provided with a plurality of bristles, and a comb assembly provided within the agitator chamber, the comb assembly circumscribing at least a portion of the brushroll and comprising a plurality of teeth that radially extend between a portion of the ribs of the brushroll.

DETAILED DESCRIPTION

The present discourse relates to vacuum cleaners and in particular to vacuum cleaners or accessory tools for vacuum cleaners having a rotatable brushroll. In operation, debris on a surface to be cleaned is swept up by the brushroll; in some cases, elongated debris such as hair may become wrapped around the brushroll and must be removed by a user by manually pulling or cutting the hair off the brushroll. In particular, the present disclosure relates to a brushroll and a comb assembly which reduces hair wrap.

Figure 1:
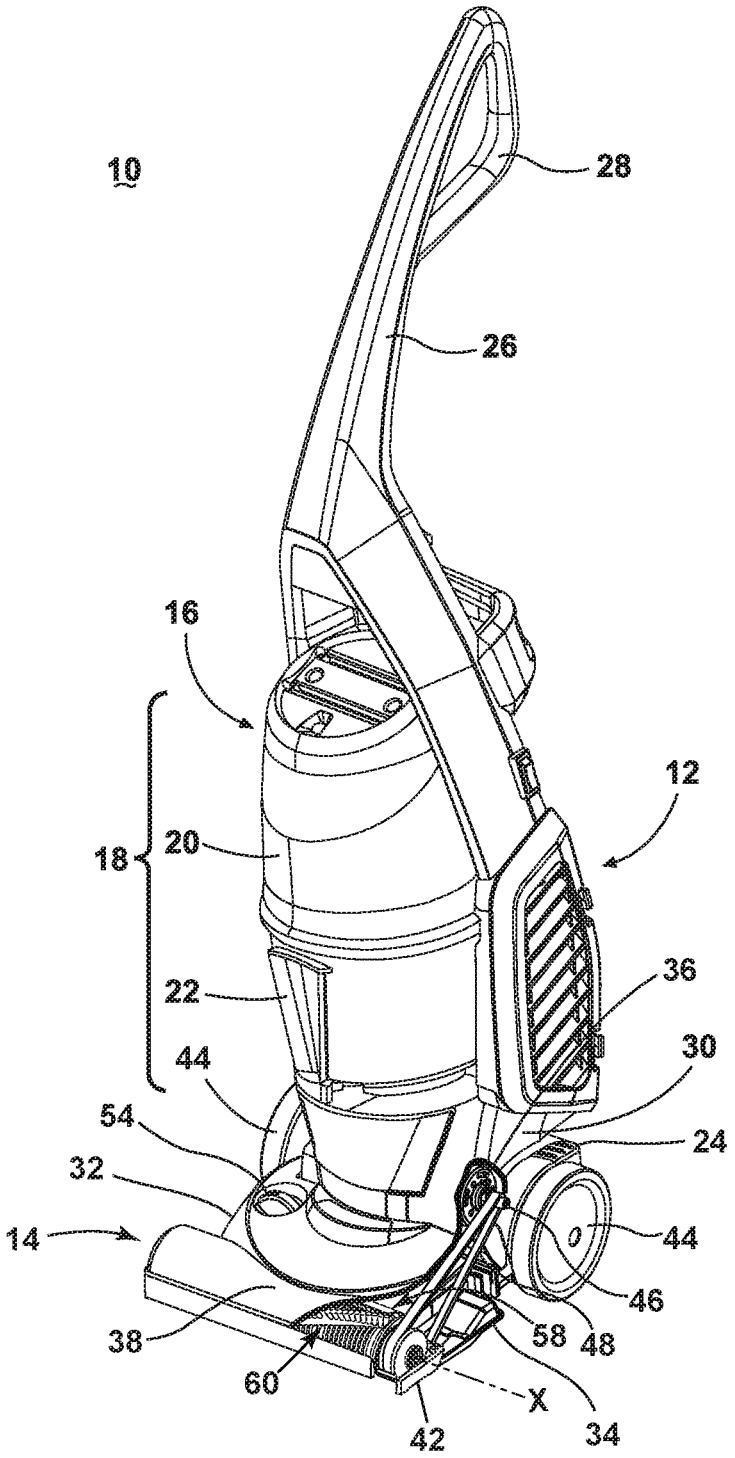
FIG. 1 is a perspective view of a vacuum cleaner according to aspects of the present disclosure, with a portion cut away for clarity.

FIG. 1 is a perspective view of a surface cleaner in the form of a vacuum cleaner 10 and more specifically in the form of an upright vacuum cleaner according to a first example of the disclosure. While shown and referred to herein as an upright vacuum cleaner, the vacuum cleaner 10 can alternatively be configured as a stick vacuum cleaner, an autonomous or robotic vacuum cleaner, a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

For purposes of description related to the figures, the terms "upper," "lower," "right," "left," "rear," "front," "vertical," "horizontal," and derivatives thereof shall relate to the disclosure as oriented in FIG. 1 from the perspective of a user behind the vacuum cleaner, which defines the rear of the vacuum cleaner. However, it is to be understood that the disclosure may assume various alternative orientations, except where expressly specified to the contrary.

As illustrated, the vacuum cleaner 10 comprises an upright body 12 pivotally mounted to a lower base 14. The upright body 12 generally comprises a main support section 16 supporting a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. The cyclone separator 20 can have a single cyclonic separation stage, or multiple stages. In another conventional arrangement, the collection system 18 can include an integrally formed cyclone separator and dirt cup, with the dirt cup being provided with a bottom-opening dirt door for contaminant disposal. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upright body 12 is pivotally mounted to the base 14 for movement between an upright storage position, shown in FIG. 1, and a reclined use position (not shown). The vacuum cleaner 10 can be provided with a detent mechanism, such as a pedal 24 pivotally mounted to the base 14, for selectively releasing the upright body 12 from the storage position to the use position. The details of the pedal 24 are known in the art, and will not be discussed in further detail herein.

The upright body 12 also has an elongated handle 26 extending upwardly from the main support section 16 that is provided with a hand grip 28 at one end that can be used for maneuvering the vacuum cleaner 10 over a surface to be cleaned. A motor cavity 30 is formed at a lower end of the main support section 16 and contains a conventional suction source, such as a motor/fan assembly 36, positioned therein in fluid communication with the collection system 18. The vacuum cleaner 10 can also be provided with one or more additional filters upstream or downstream of motor/fan assembly.

In FIG. 1, a lower portion of the vacuum cleaner 10 is cut away to show features of the base 14. The base 14 can include an upper housing 32 that couples with a lower housing 34 to create a partially enclosed space therebetween. An agitator chamber 38 can be provided at a forward portion of the lower housing 34 for receiving a brushroll 60. A suction nozzle opening 42 is formed in the lower housing 34 and is in fluid communication with the agitator chamber 38 and the collection system 18. Wheels 44 can be provided on the base 14 for maneuvering the vacuum cleaner 10 over a surface to be cleaned.

The brushroll 60 is positioned within the agitator chamber 38 for rotational movement about a central rotational axis X. A single brushroll 60 is illustrated; however, it is within the scope of the disclosure for dual rotating brushrolls to be used. Moreover, it is within the scope of the disclosure for the brushroll 60 to be mounted within the agitator chamber 38 in a fixed or floating vertical position relative to the agitator chamber 38 and lower housing 34.

The brushroll 60 can be operably coupled to and driven by the motor/fan assembly 36 in the motor cavity 30. The motor/fan assembly 36 can comprise a motor shaft 46 which is oriented substantially parallel to the surface to be cleaned and protrudes from the motor cavity 30 into a rear portion of the base 14. A drive belt 48 operably connects the motor shaft 46 to the brushroll 60 for transmitting rotational motion of the motor shaft 46 to the brushroll 60. It is contemplated that a separate, dedicated agitator drive motor (not shown) can be provided within the base 14 to drive the brushroll 60. It is further contemplated that the brushroll 60 can be operably coupled to and driven by one or more motors (not shown) housed within the brushroll 60 or adjacent the brushroll 60.

A comb assembly 58 is positioned within the agitator chamber 38. The comb assembly 58 can be a stationary structure coupled to or formed with one or more portions of the base 14, the upper housing 32 or the lower housing 34, however other locations are contemplated. The comb assembly 58 can be adjacent to and partially circumscribe the brushroll 60.

The base 14 can further include an optional suction nozzle height adjustment mechanism for adjusting the height of the suction nozzle opening 42 with respect to the surface to be cleaned. A rotatable knob 54 for actuating the adjustment mechanism can be provided on the exterior of the base 14. In another variation, the suction nozzle height adjustment mechanism can be eliminated.

In operation, the vacuum cleaner 10 draws in debris-laden air through the base 14 and into the collection system 18 where the debris, which can include, but is not limited to, dirt, dust, hair, and other debris, is substantially separated from the working air flow, which is generated by the motor/fan assembly 36. The spinning motor shaft 46 of the motor/fan assembly 36 rotates the brushroll 60 via the drive belt 48 that is operably connected therebetween. Alternatively, a separate, dedicated agitator drive motor can rotate the brushroll 60. As the brushroll 60 rotates, the bristles sweep across the surface to be cleaned to release and propel debris into the working air flow generated by the motor/fan assembly 36, which carries the debris into the collection system 18. The working air flow then passes through the motor cavity 30 and past the motor/fan assembly 36 prior to being exhausted from the vacuum cleaner 10. The collection system 18 can be periodically emptied of debris.

Figure 2:
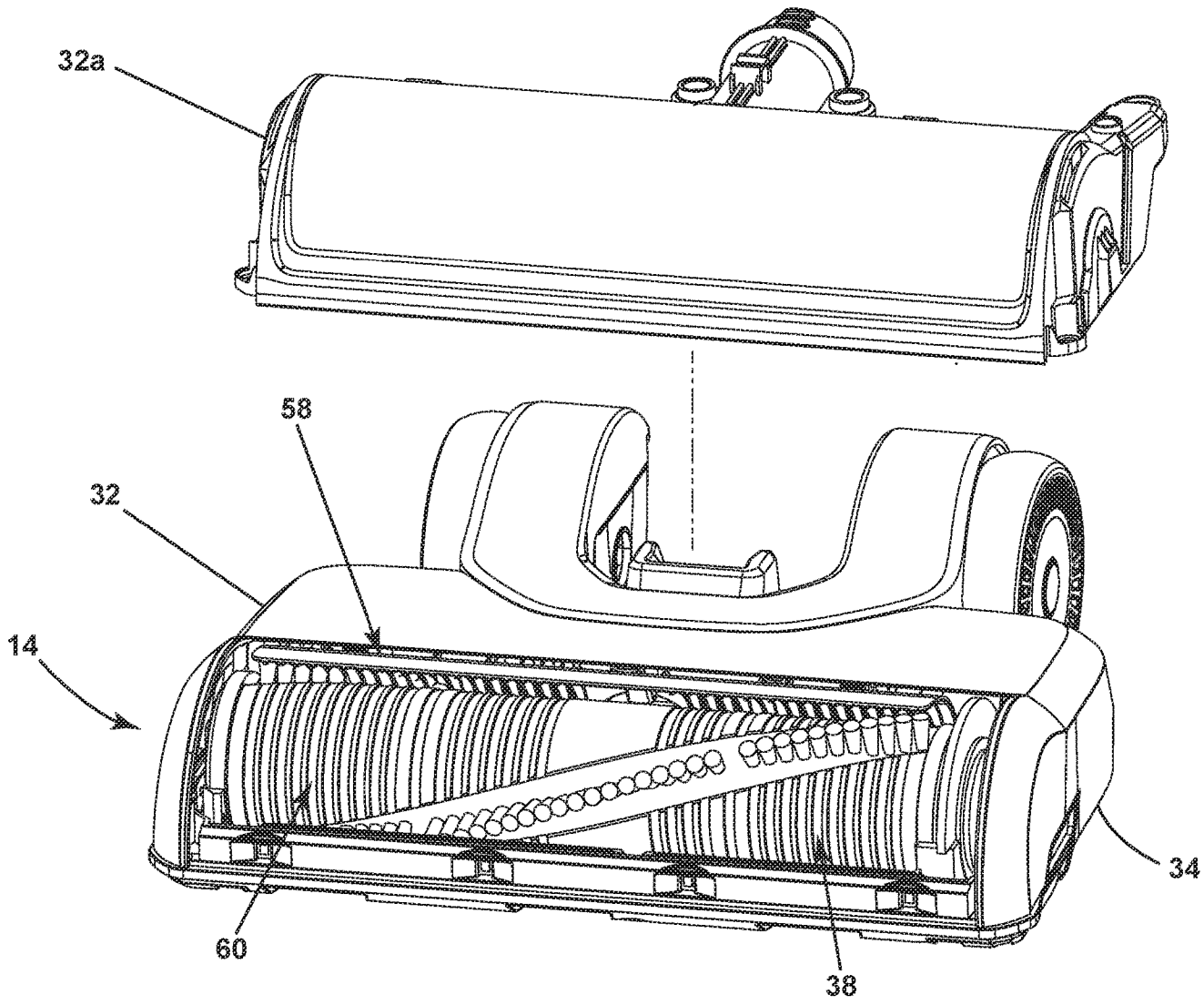
FIG. 2 is a partially exploded view of a base that can be utilized with the vacuum cleaner of FIG. 1.

FIG. 2 further illustrates an alternative exemplary base 14 that can be utilized with the vacuum cleaner 10. To the extent similar features are included numerals remain the same as in FIG. 1. In the illustration, a portion 32*a* of the upper housing 32 is exploded to show features of the agitator chamber 38. The agitator chamber 38 includes at least the brushroll 60 and the comb assembly 58. The comb assembly 58 can extend at least a portion of the axial length of the brushroll 60. It is contemplated that the brushroll 60 can be selectively removed from the agitator chamber 38 by a user. It is further contemplated that the comb assembly 58 can be selectively removed from the agitator chamber 38 by a user such as for replacement.

Figure 3:
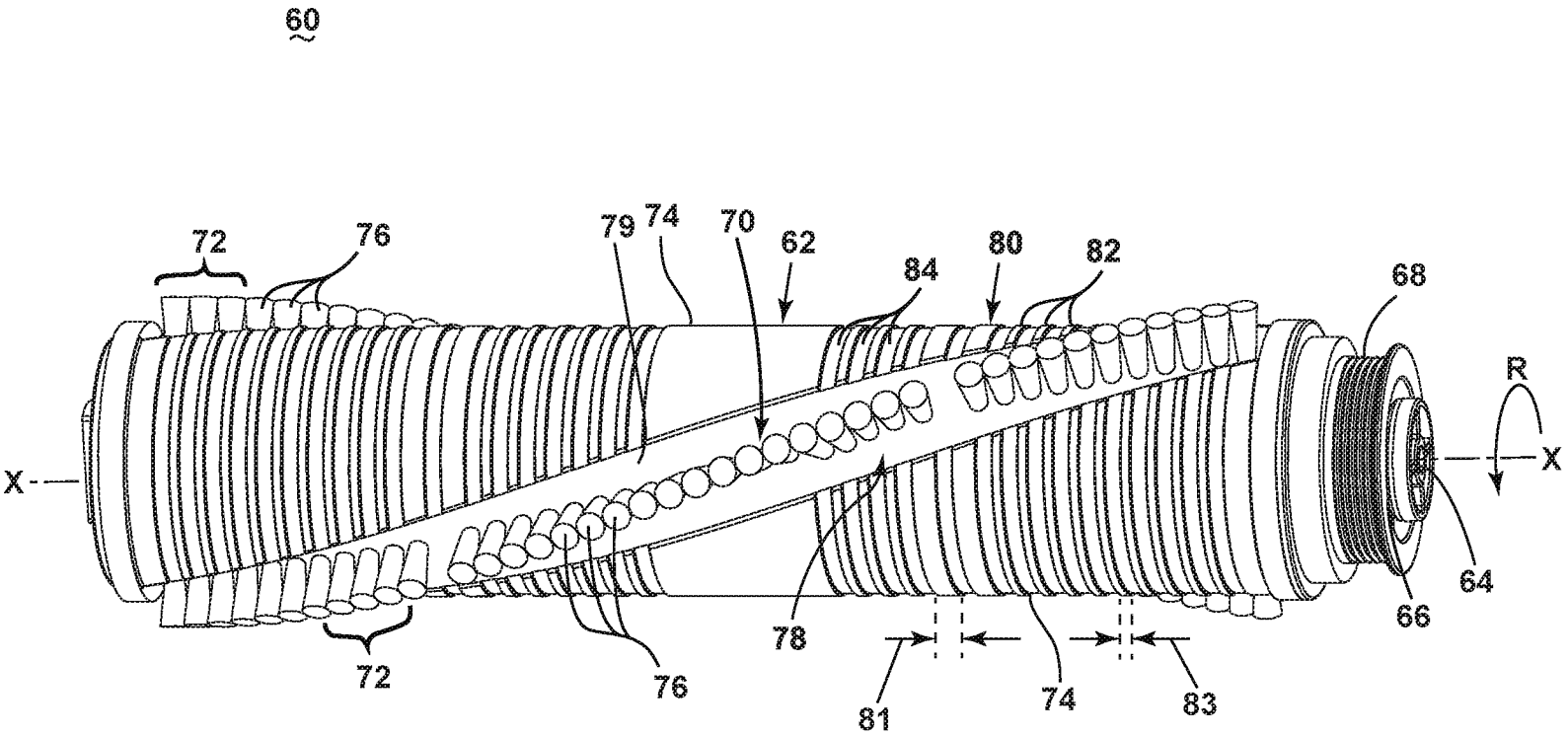
FIG. 3 is a perspective view of a brushroll for the vacuum cleaner of FIG. 1 and FIG. 2.

FIG. 3 is a perspective view of the brushroll 60. The brushroll 60 includes a brush dowel 62 configured to be mounted for rotation about a central rotational axis X extending longitudinally through the brush dowel 62. The brush dowel 62 is mounted on an elongated shaft 64 that extends through the center of the brush dowel 62 and defines the central rotational axis X around which the brushroll 60 rotates. The brushroll 60 illustrated is configured to be rotationally driven in the direction indicated by arrow R. A bearing 66 is mounted on each end of the shaft 64. In operation, the brush dowel 62 rotates about the shaft 64 on the bearings 66. A belt engagement surface 68 extends around the circumference of the brush dowel 62. While illustrated near one end, it is contemplated that the belt engagement surface 68 can be located on any one or more portions of the brush dowel 62. The belt engagement surface 68 can communicate with the drive belt 48 (FIG. 1). The belt engagement surface 68 can comprise a pulley.

Optionally, the brush dowel 62 does not need to include a belt engagement surface 68. For example, the brushroll 60 can be driven from a motor located within the brush dowel 62.

The brush dowel 62 further includes one or more bristle supports 70 which project into the brush dowel 62. A plurality of bristles 72 protrude from the bristle supports 70, and can be provided in a series or row of discrete tufts or in a continuous strip. The bristles 72 can be arranged in various patterns on the brush dowel 62, including straight, angled, helical, or combinations thereof.

The brushroll 60 is designed to prevent or greatly reduce the amount of hair wrap during operation by providing a shroud surface 74 for wrapping hair. The shroud surface 74 is provided adjacent to the bristles 72 in order to establish a shallower hair wrap angle.

Figure 6:
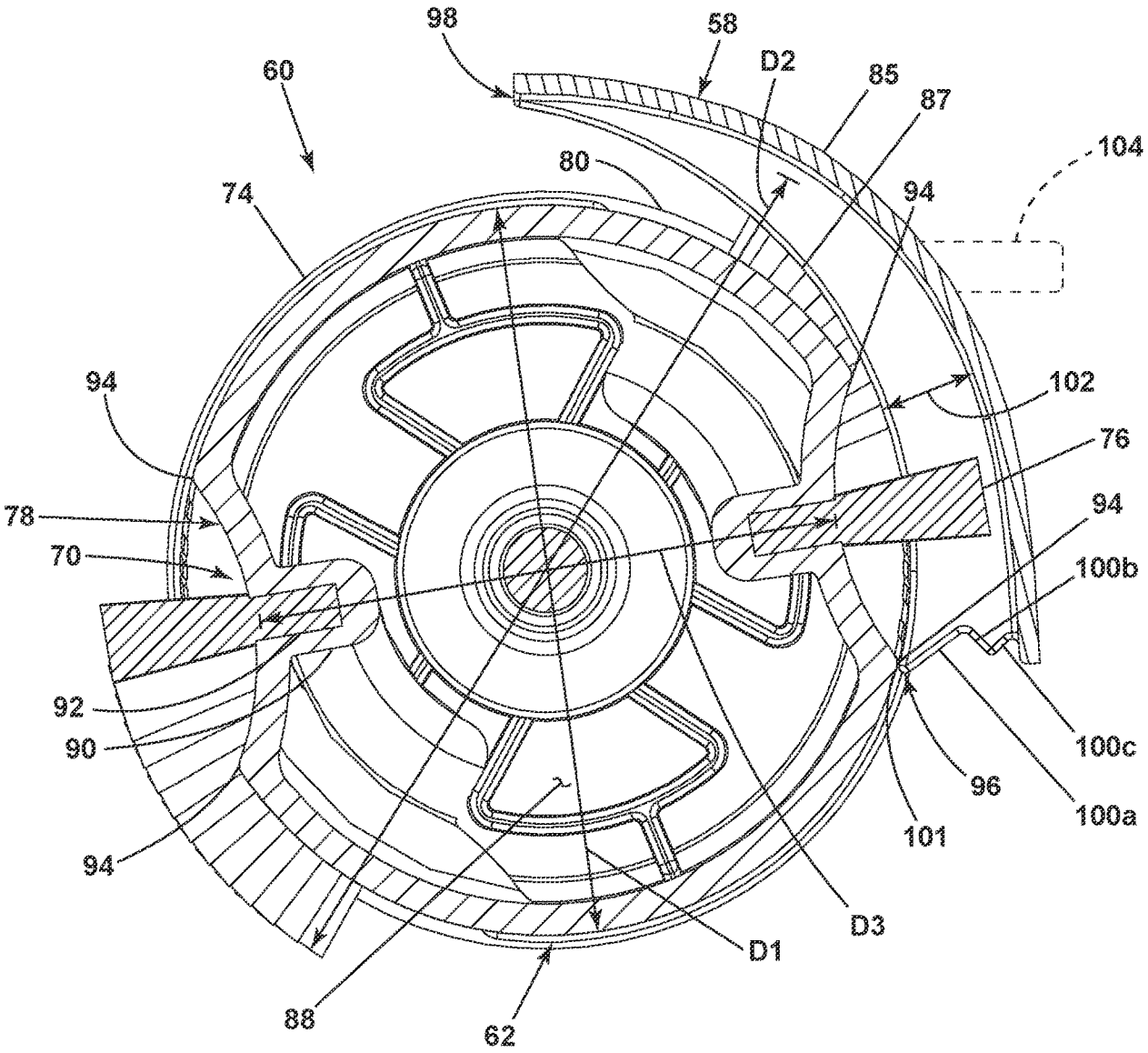
FIG. 6 is a cross-sectional view of the brushroll and the comb assembly taken through line V-V of FIG. 4.

In the illustrated example, two bristle supports 70 and two corresponding rows of bristle tufts 76 are provided on the brush dowel 62, each tuft 76 containing a plurality of bristles 72, and extend in a generally helical pattern around the circumference of the brush dowel 62. The outer surface of the brush dowel 62 includes opposing curved sections, also seen in FIG. 6, shown herein as convex curved surfaces defining the shroud surface 74 and concave curved surfaces defining mounting surfaces 78, where the mounting surfaces 78 include the bristle supports 70 from which the tufts 76 project. A channel 79 can be defined by the concave curved sections of the mounting surfaces 78, adjacent the bristles 72 or bristle supports 70. The channel 79 can extend axially along the brush dowel 62 and can allow for scissors or other cutting implements to be moved axially along the brush dowel 62 adjacent the bristles 72 or bristle supports 70. The channel 79 can be straight or curved to follow the helical path of the bristles 72 or the tufts 76.

The shroud surface 74 can include a plurality of ribs 80. The plurality of ribs 80 can circumscribe at least a portion of the brush dowel 62. In the illustrated example, the plurality of ribs circumscribes the dowel between the two bristle supports 70. While not illustrated it is contemplated that the ribs can extend along the bristle supports 70. The plurality of ribs 80 can each have a peak or top portion 82. A rib width can be measured across the top portion 82 of each rib of the plurality of ribs 80. As illustrated, by way of example, the plurality of ribs 80 can have at least a first rib width 81 and a second rib width 83, where the first rib width 81 is different than the second rib width 83. In alternative configurations a width of a single rib may vary along a height of the rib.

The top portion 82 of each of the plurality of ribs 80 can be curved, parallel to the shroud surface 74, or linearly sloped, or any combination therein. It will be understood that the ribs may have any suitable shape, profile, geometry, and sizing.

Voids or recesses 84 can be defined by spacing between adjacent ribs of the plurality of ribs 80.

The plurality of ribs 80 can formed from material extending from the shroud surface 74 along the circumference of the brush dowel 62. That is, the plurality of ribs 80 can circumferentially extend from the shroud surface 74. Additionally, or alternatively, the plurality of ribs 80 can be formed by the shroud surface 74, where the recesses 84 are material removed at the shroud surface 74 to form the plurality of ribs 80.

Figure 4:
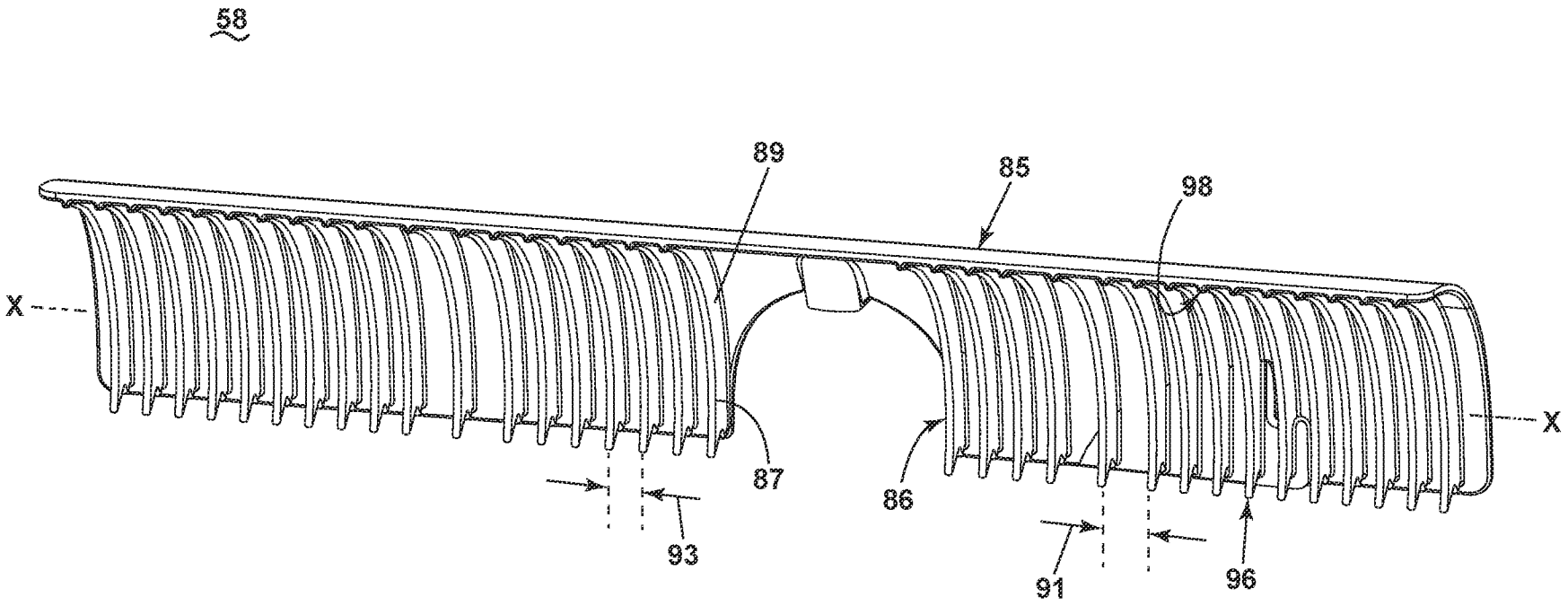
FIG. 4 is a perspective view of a comb assembly for the vacuum cleaner of FIG. 1 and FIG. 2.

FIG. 4 is a perspective view of the comb assembly 58. The comb assembly 58 can include a plurality of teeth 86. The plurality of teeth 86 can extend radially inward from a surface or wall 85. An arc 87 can be defined by a surface or edge that is farthest from the wall 85. A sidewall 89 of each tooth of the plurality of teeth 86 can extend between the wall 85 and the arc 87.

The sidewall 89 can extend circumferentially about the axis X from a leading edge 96 to a trailing edge 98. The leading edge 96 can include at least one serrated, pointed, barbed, tapered, hooked, or otherwise sharpened edge.

A gap distance can be defined as an axial distance between the leading edge 96 of adjacent teeth of the plurality of teeth 86. As illustrated, by way of example, the gap distance can be a first gap distance 91 and a second gap distance 93, where the second gap distance 93 is different than the first gap distance 91.

The plurality of teeth 86 are illustrated as extending generally perpendicular (85-95 degrees) from the wall 85, however it is contemplated that each tooth of the plurality of teeth 86 can extend from the wall 85 at a variety of angles. As illustrated, the axial distance between adjacent teeth at the leading edge 96 and the trailing edge 98 can be equal or within 5%. However, it is contemplated that the trailing edge distance (axial distance between adjacent teeth at the trailing edge 98) can be different than the corresponding gap distance (axial distance between adjacent teeth at the leading edge 96).

Figure 5:
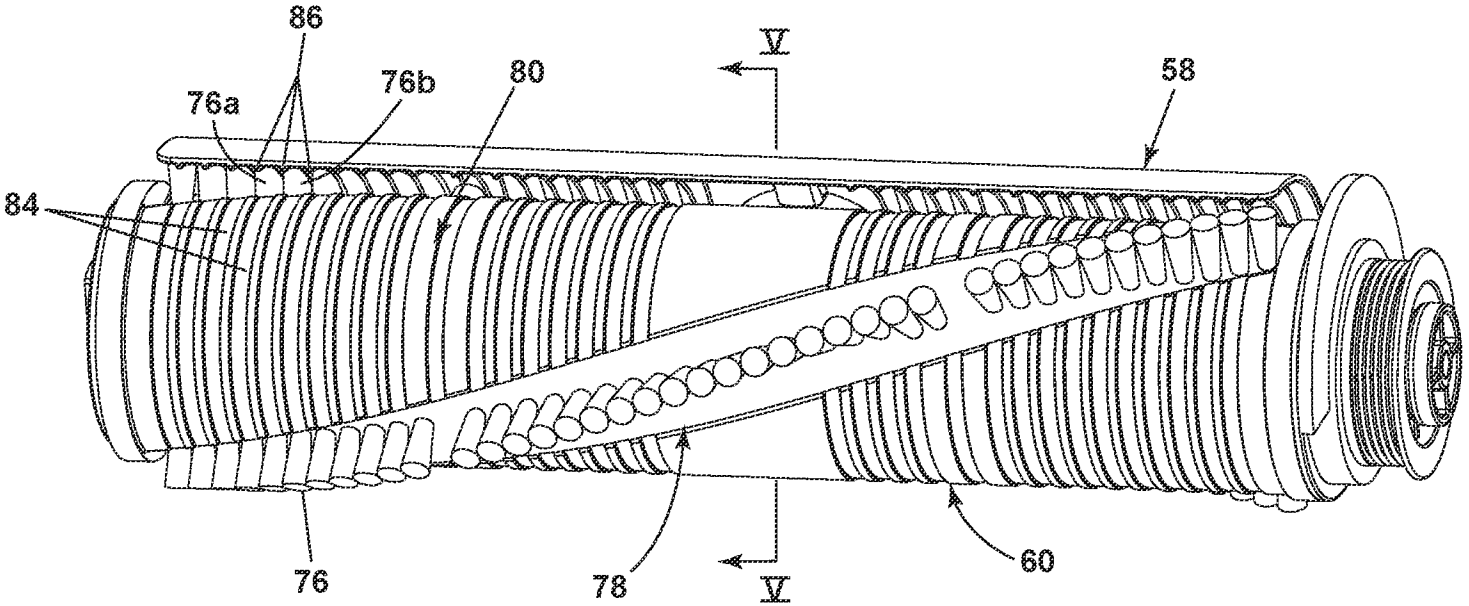
FIG. 5 is a perspective view of the brushroll and the comb assembly for the vacuum cleaner of FIG. 1 and FIG. 2.

FIG. 5 is a perspective view of the brushroll 60 and the comb assembly 58. The plurality of teeth 86 of the comb assembly 58 can radially align with recesses 84 between each of the plurality of ribs 80. It is contemplated that each tooth of the plurality of teeth 86 can pass between two adjacent tufts 76*a*, 76*b* extending from the mounting surface 78. That is, each tooth of the plurality of teeth 86 can align with a gap between two adjacent tufts 76*a*, 76*b* or separate the two adjacent tufts 76*a*, 76*b* as the two adjacent tufts 76*a*, 76*b* rotate through the comb assembly 58. However, it can equally be contemplated that some of the plurality of teeth 86 are aligned to pass through portions of the tufts in alternative aspects.

FIG. 6 is a cross section of the brushroll 60 and the comb assembly 58 of FIG. 4. taken through line V-V of FIG. 4. The cross section can be considered to be taken at one of the recesses 84 with the adjacent rib 80 shown. The brush dowel 62 can define a hollow interior 88 that extends along the length of the brush dowel 62. The shaft 64 is received within the hollow interior 88. The bristle supports 70 further include bristle support platforms 90 which project from the mounting surfaces 78 into the hollow interior 88 of the brush dowel 62. Bristle holes 92 for the bristle tufts 76 can be formed in the mounting surface 78 and can extend at least partially into the platforms 90.

While illustrated as a series of discrete tufts 76, it is contemplated that the bristles 72 can be arranged in one or more continuous strips, or any combination of continuous strips and discrete tufts. That is, the bristles 72 can be arranged in various patterns on the brush dowel 62 or in the one or more platforms 90, including straight, angled, helical, or combinations thereof.

The bristle holes 92 can be formed in the brush dowel 62 by drilling into the brush dowel 62 after molding, or can be integrally molded with the brush dowel 62. The bristle tufts 76 can be assembled with the brush dowel 62 by pressing bristles 72 into the bristle holes 92 and securing the bristles 72 using a fastener (not shown), such as, but not limited to, a staple, wedge, or anchor. The brush dowel 62 can comprise a polymeric material, such as polypropylene, acrylonitrile butadiene styrene (ABS), or styrene. The bristles 72 can comprise a polymeric material, such as nylon or polyester, for example, which allows the bristles 72 to flex and deflect when brought into contact with a surface to be cleaned during normal operation. Other manufacturing methods can also be used to produce the brushroll 60 shown in FIG. 6.

As noted above, the brushroll 60 is designed to prevent or greatly reduce the amount of hair wrap during operation by providing the shroud surface 74 for wrapping hair. In the illustrated example, the brush dowel 62 defines a major diameter D1, which is the diameter defined by the smallest circle that can enclose the shroud surface 74 of the brush dowel 62. The bristle tufts 76 define a trim diameter D2, which is slightly larger than the major diameter D1. The mounting surfaces 78 are recessed below the major diameter D1, and therefore below the shroud surface 74, which allows the bristles 72 on the mounting surfaces 78 to deflect when contacting the surface to be cleaned, while keeping any hair at or near the tip of the bristles 72. For example, the bristle supports 70 define a minor diameter D3 of the brush dowel 62. The minor diameter D3 can be defined at the tufting locations of the bristle tufts 76 in the bristle supports 70. The minor diameter D3 can be less than the major diameter D1 and the trim diameter D2. In the illustrated example, the minor diameter D3 is the diameter defined by the smallest circle that can touch both mounting surfaces 78 of the bristle supports 70, at the tufting locations of the bristle tufts 76. Other configurations for a brushroll having bristle supports 70 and shroud surface 74 may have major and minor diameters D1, D3 defined in other manners, as long as the shroud surface 74 defines D1 and the bristle supports 70 define D3.

The outer surface of the brush dowel 62 shown in FIG. 5 further includes inflection points or outside corners 94 where the convex curved surfaces defining the shroud surface 74 intersect the concave curved sections defining mounting surfaces 78. The outside corners 94 can be rounded, curved, or sharp corners.

The comb assembly 58 partially circumscribes or forms an arc about a portion of the brushroll 60. That is, the wall 85 circumscribes at least a portion of the brushroll 60. The plurality of teeth 86 extend radially inward from the wall 85 toward the brushroll 60. The plurality of teeth 86 are received by the recesses 84 defined between adjacent ribs of the plurality of ribs 80 (see FIG. 7).

A radial width 102 of each of the plurality of teeth 86 can be measured from the wall 85 to the corresponding arc 87. The radial width 102 can change as the plurality of teeth 86 extend circumferentially about the brushroll 60. As illustrated, by way of example, the radial width 102 can decrease or remain the same from the leading edge 96 to the trailing edge 98.

The leading edge 96 can include at least one sharpened edge. The at least one sharpened edge can be a series of sharpened edges, illustrated as a first sharpened edge 100*a*, a second sharpened edge 100*b*, and a third sharpened edge 100*c*.

Optionally, at least one mounting structure 104 can be formed with or attached to the wall 85 of the comb assembly 58. The at least one mounting structure 104 can fixedly or removably mount the comb assembly 58 to one or more portions of the base 14, the lower housing 34, or the upper housing 32 (see FIG. 2). The comb assembly 58 can be removed from the agitator chamber 38 (see FIG. 2) to sharpen on or more surfaces of the plurality of teeth 86 or be replaced with a new comb assembly.

While any mechanical or magnetic coupling is contemplated, the at least one mounting structure 104 can include an eyelet that receives a fastener such as, but not limited to, a screw. Alternatively, the at least one mounting structure 104 can be a latching mechanism that can, for example, snap into a portion of the base 14 or rotate to engage a portion of the base 14.

Figure 7:
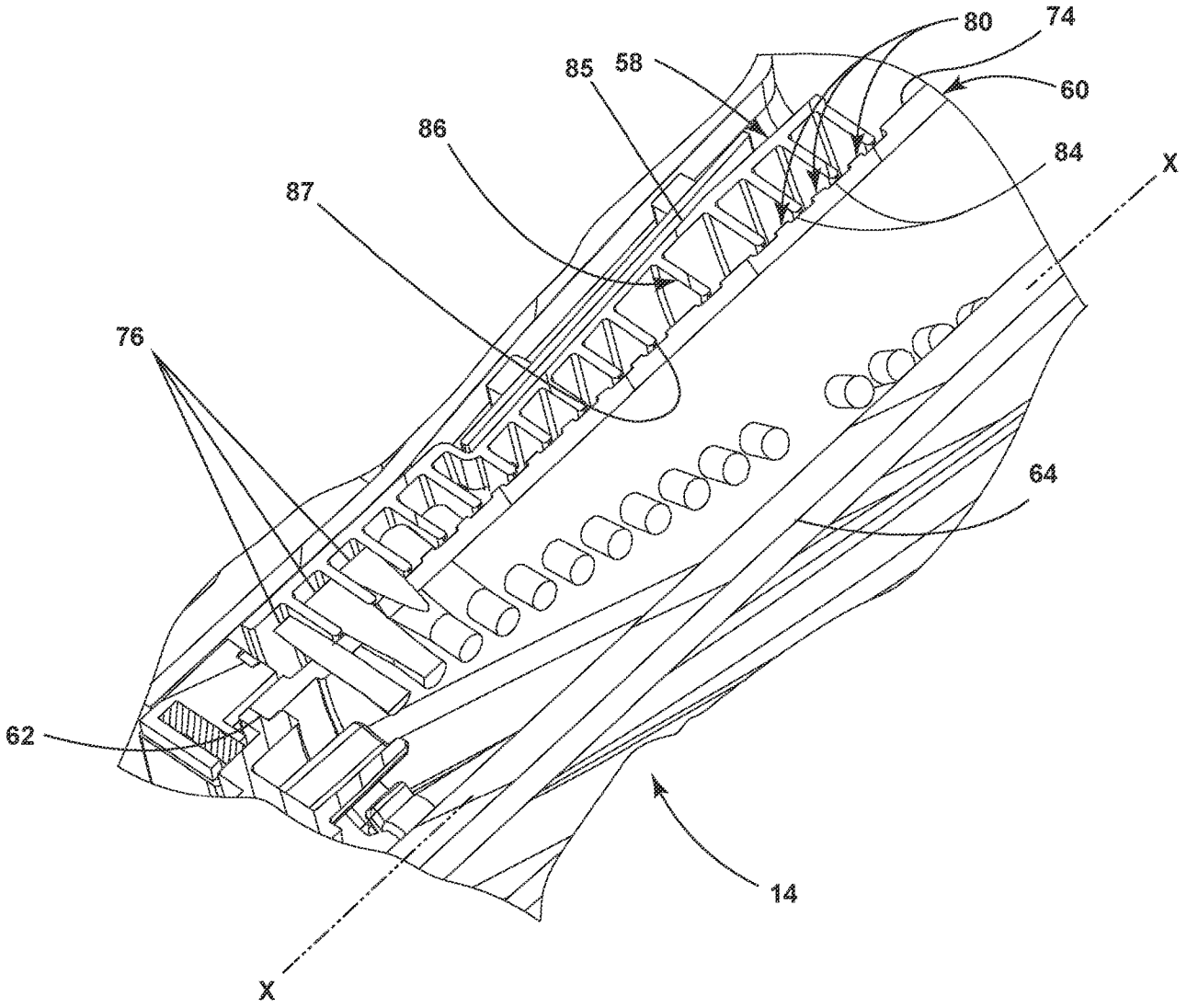
FIG. 7 is a partial cross section of a portion of the vacuum cleaner of FIG. 1 and FIG. 2.

FIG. 7 is a partial cross section of the base 14 of FIG. 2 to further illustrated the orientation of the comb assembly 58 relative to the brushroll 60. The cross section can be taken at the elongated shaft 64 that extends through the center of the brush dowel 62 and defines the central rotational axis X around which the brushroll 60 rotates.

As illustrated, the plurality of teeth 86 extend radially inward from the wall 85 towards the brush dowel 62. While illustrated as extending from the wall 85 at an angle between 85 degrees and 95 degrees, any angle is contemplated.

Each tooth of the plurality of teeth 86 can align with at least one of the recesses 84 defined by the plurality of ribs 80 defined or extending from the shroud surface 74 of the brush dowel 62. At least a portion of each tooth or the plurality of teeth 86 can be received by the corresponding recess 84. While illustrated as spaced from the brush dowel 62, it is contemplated that the leading edge 96 (see FIG. 6) or a portion of the arc 87 can contact a portion of the brush dowel 62.

The rotating tufts 76 extending from the brushroll 60 can pass between adjacent teeth of the plurality of teeth 86. That is, as the tufts 76 rotate past or through the comb assembly 58, at least a portion of one of the tufts 76 can pass between adjacent teeth of the plurality of teeth 86.

During operation, the brushroll 60 is configured to be rotationally driven in the direction indicated by arrow R. While the brushroll 60 is described herein as being rotatably driven by a motor, it is understood that the brushroll 60 can be driven by other means, such as, but not limited to, a turbine fan or a mechanical gear train.

As the bristles 72 come into contact with the surface to be cleaned, the bristles 72 are deflected. Debris, which can include, but is not limited to, dirt, dust, and hair, on the surface to be cleaned is swept up by the brushroll 60.

In some cases, hair, for example, can be pulled off the bristles 72 by the suction force of the vacuum cleaner 10. In other cases, as the bristles 72 hold the hair, which then rotates with the bristles 72 about the brush dowel 62.

After picking up the hair, the bristles 72 can rotate to the comb assembly 58. The bristles 72 or tufts 76 enter the comb assembly 58 at the leading edge 96 of the plurality of teeth 86. One or more of the tufts 76 can align with one of the plurality of ribs 80, such that as the tufts 76 rotate through the comb assembly 58, the plurality of teeth 86 can pass between the tufts 76 or groups of tufts. That is, at least a subset of the bristle holes 92 axially align with a rib from the plurality of ribs 80 and as the brushroll 60 rotates, the plurality of teeth 86 pass between the tufts 76 mounted in the subset of the bristle holes 92.

A portion or tip 101 of the leading edge 96 extends into the recesses 84 between each of the plurality of ribs 80. That is, a portion of the leading edge 96 of the plurality of teeth 86 is received by the recesses 84 between the plurality of ribs 80. It is contemplated a portion of the leading edge 96 can extend through the recess 84 to the shroud surface 74. It also contemplated that the leading edge 96 can remain adjacent to and not in contact with the shroud surface 74 as the portion or tip 101 of the leading edge 96 extends into the recess 84 between adjacent ribs of the plurality of ribs 80.

The leading edge 96 of the plurality of teeth 86 can include, for example, the first sharpened edge 100*a* extending from the tip 101, the second sharpened edge 100*b* extending from the first sharpened edge 100*a*, and the third sharpened edge 100*c* extending from the second sharpened edge 100*b*. The sharpened edges 100*a*, 100*b*, 100*c*, can be arranged, for example, in a variety of directions such as, but not limited to a saw-tooth or sinusoidal pattern. The sharpened edges 100*a*, 100*b*, 100*c*, pass between at least some of the rotating bristles 72 or the rotating tufts 76. The hair can be cut, hooked, pulled, or otherwise removed from the rotating bristles 72 or the rotating tufts 76 by the sharpened edges 100*a*, 100*b*, 100*c*, the leading edge 96, or other portions of the comb assembly 58.

Occasionally, the hair cannot be cut or pulled off the brushroll 60 by the comb assembly 58 or the suction force of the vacuum cleaner 10. In this situation, the user must manually remove the hair wound around the brush dowel 62. Scissors or another cutting implement can be inserted by the user along the concave curved sections or the channel 79 adjacent the bristle supports 70.

It is further contemplated that the angle or length of the bristles 72, the location of the tufts 76, the differences in the major diameter D1 and the trim diameter D2, or the radius of curvature or the angle formed at the outside corners 94 by the shroud surface 74 and mounting surfaces 78 can further reduce the chance of hair or other debris wrapping around the brush dowel 62.

The brushroll 60 can be used with various vacuum cleaners, including an upright-type vacuum cleaner, a canister-type vacuum cleaner, a stick vacuum cleaner, an autonomous or robotic vacuum cleaner (see FIG. 6), or a hand-held vacuum cleaner, or accessory tools therefore. Furthermore, the vacuum cleaner or accessory tool can additionally be configured to distribute a fluid and/or to extract a fluid, where the fluid may for example be liquid or steam. The term "surface cleaning apparatus" as used herein includes both vacuum cleaners and accessory tools for vacuum cleaners, unless expressly noted.

Figure 8:
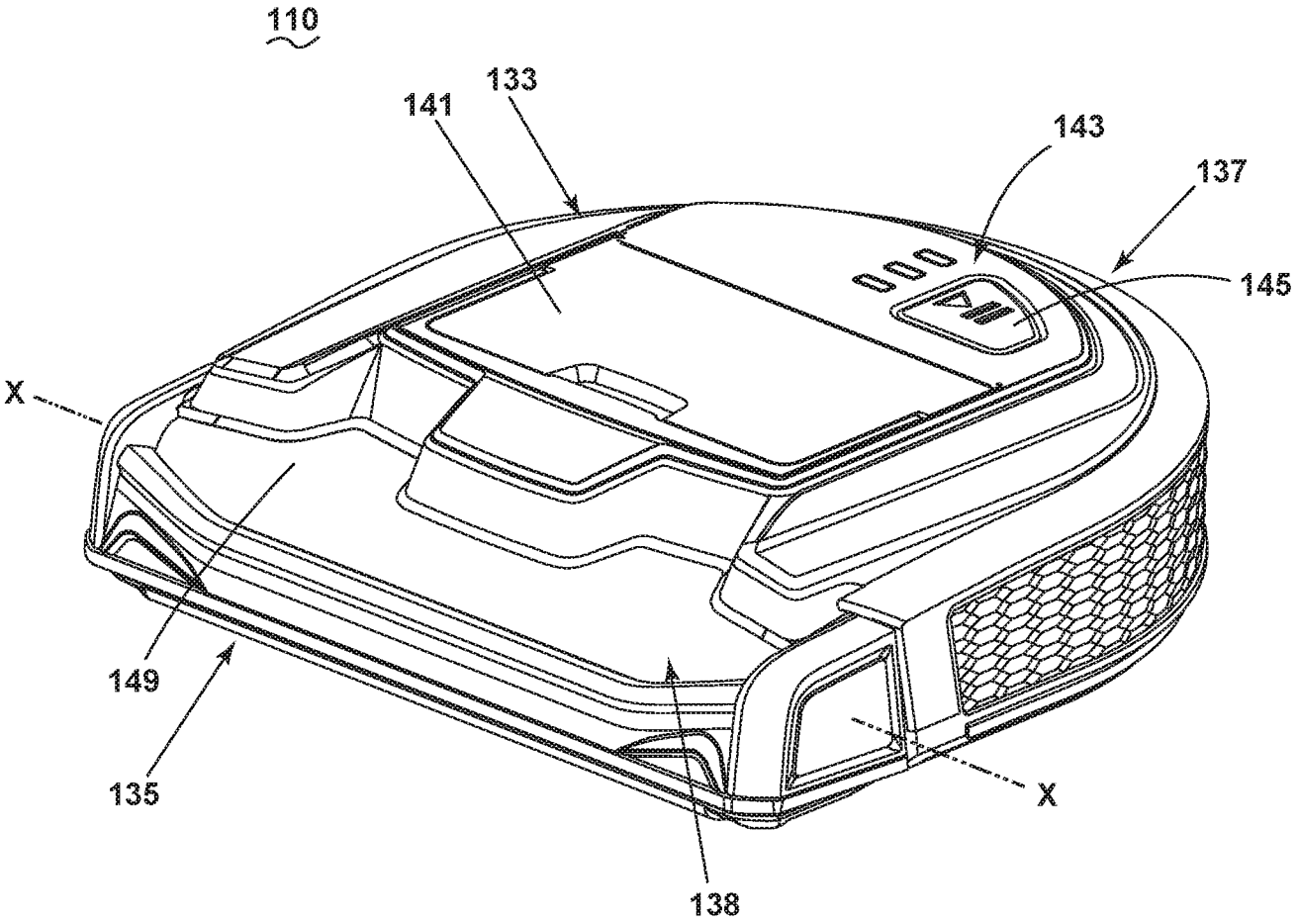
FIG. 8 is a perspective view of an autonomous vacuum cleaner according to aspects of the present disclosure.

FIG. 8 illustrates an autonomous vacuum cleaner 110 having an agitation chamber 138 that can be located at a front of the housing 133.

As used herein, "front" or "forward" and variations thereof are defined relative to the direction of forward travel of the autonomous vacuum cleaner 110, unless otherwise specified. A brushroll is mounted for rotation about a substantially horizontal axis X, relative to the surface over which the housing 133 moves.

The housing 133 of the illustrated autonomous vacuum cleaner 110 can be configured to accommodate the brushroll in the forward location, such as by having an overall "D-shape" when viewed from above, with the housing 133 having a straight front edge 135 and a rounded rear edge 137.

The vacuum collection system can include a working air path through the housing 133 having an air inlet and an air outlet, a suction nozzle, a suction source in fluid communication with the suction nozzle for generating a working air stream, and a dirt bin 141 for collecting dirt from the working airstream for later disposal. The suction nozzle can define the air inlet of the working air path and can couple with the agitation chamber 138. The suction source can be a motor/fan assembly carried by the housing 133, fluidly upstream of the air outlet, and can define a portion of the working air path. The dirt bin 141 can also define a portion of the working air path, and comprise a dirt bin inlet in fluid communication with the air inlet. A separator can be formed in a portion of the dirt bin 141 for separating fluid and entrained dirt from the working airstream. Some non-limiting examples of the separator include a cyclone separator, a filter screen, a foam filter, a HEPA filter, a filter bag, or combinations thereof.

The suction source can be electrically coupled to a power source, such as a rechargeable battery. In one example, the battery can be a lithium ion battery. Charging contacts for the rechargeable battery can be provided on the exterior of the main housing. A docking station (not shown) for receiving the unit for charging can be provided with corresponding charging contacts. A first user interface 143 having at least a suction power switch 145 between the suction source and the power source can be selectively closed by the user, thereby activating the suction source. A drive system can include drive wheels for driving the unit across a surface to be cleaned. The drive system can also include a distance sensor.

The autonomous vacuum cleaner 110 can include a transparent brushroll window 149 at a front of the housing 133. The brushroll window 149 defines a portion of the agitation chamber 138 in which a brushroll 160 and a comb assembly 158 can be mounted (see FIG. 9).

Figure 9:
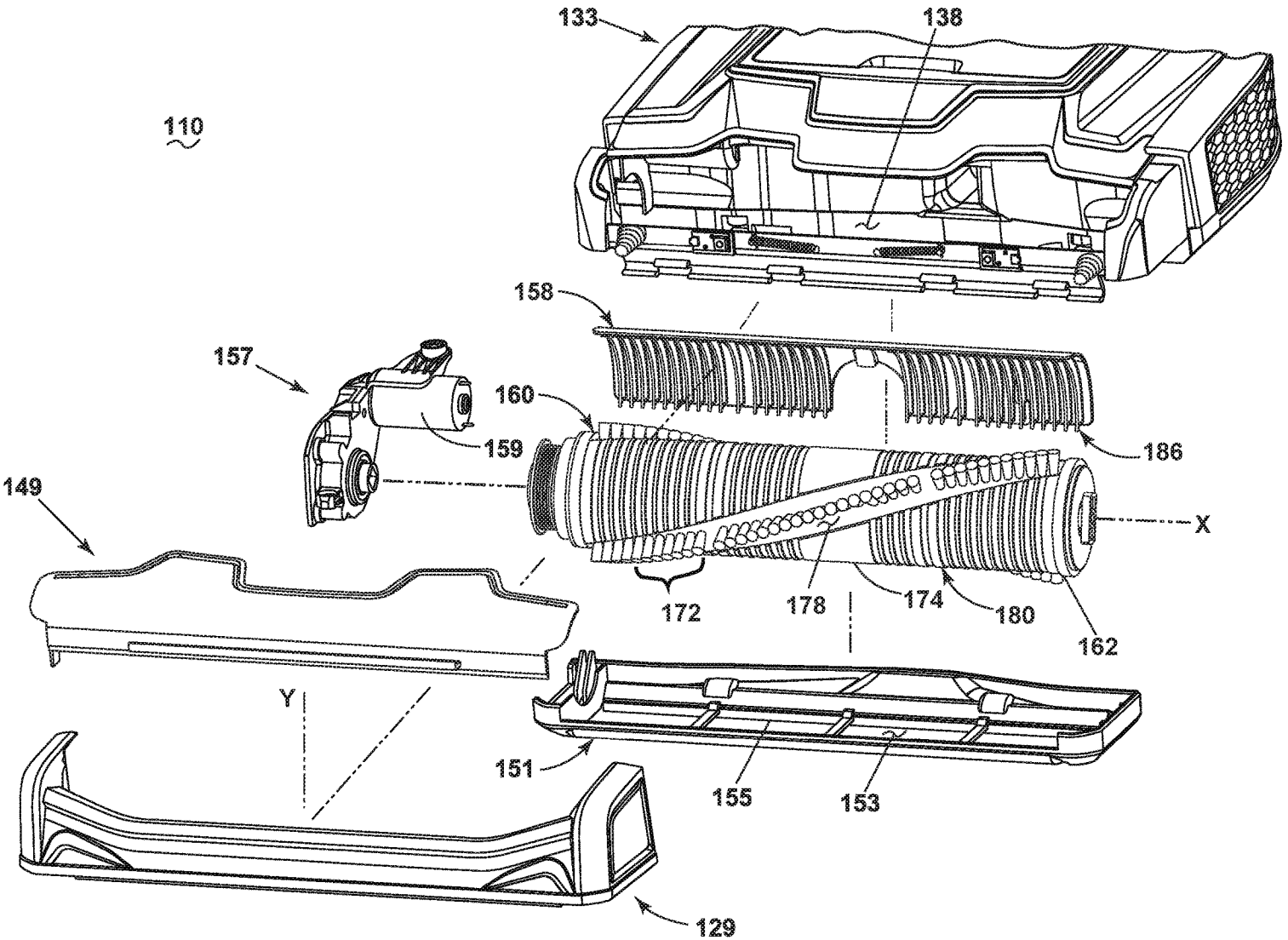
FIG. 9 is a partially exploded view of the autonomous vacuum cleaner of FIG. 8.

FIG. 9 further illustrates the brushroll 160 and the comb assembly 158 in a partially exploded view of the autonomous vacuum cleaner 110. The brushroll 160 is similar to the brushroll 60, therefore, like parts will be identified with like numerals increased by 100, with it being understood that the description of the like parts of the brushroll 60 applies to the brushroll 160 unless otherwise noted. Similarly, the comb assembly 158 is similar to the comb assembly 58, therefore, like parts will be identified with like numerals increased by 100, with it being understood that the description of the like parts of the comb assembly 58 applies to the comb assembly 158 unless otherwise noted.

A sole plate 151 can at least partially retain the brushroll 160 in the agitation chamber 138, and has an inlet opening defining a suction nozzle 153. Optionally, a wiper blade 155 can be provided adjacent a trailing edge of the suction nozzle 153, behind the brushroll 160 in order to aid in dust collection. The wiper blade 155 is an elongated blade that generally spans the width of the suction nozzle 153, and can be supported by the sole plate 151.

A bumper assembly 129 can be provided at the front of the housing 133, and may extend across a front portion of the agitation chamber 138 and/or the brushroll window 149.

An agitator drive assembly 157 including a separate, dedicated agitator drive motor 159 can be provided within a housing 133 to drive the brushroll 160 and can include a drive belt (not shown) that operably connects a motor shaft of the agitator drive motor 159 with the brushroll 160 for transmitting rotational motion of the motor shaft to the brushroll 160. Alternatively, the brushroll 160 can be driven by a suction source.

The brushroll 160 can be removable from the housing 133 for cleaning and/or replacement. The brushroll 160 includes brush dowel 162 having a mounting surface 178 and a shroud surface 174. A plurality of ribs 180 extend radially outward from the shroud surface 174 along the circumference of brush dowel 162.

The comb assembly 158 can be mounted in the agitation chamber 138 between the brushroll 160 and the housing 133. The comb assembly 158 can be removable from the housing 133 for cleaning, sharpening, and/or replacement.

As the brushroll 160 rotates about an axis X, the plurality of teeth 186 of the comb assembly 158 can at least partially extend between the plurality of ribs 180.

The plurality of teeth 186 of the comb assembly 158 can aid in the removal of hair or other debris from bristles 172 that extend from the mounting surface 178 of the brush dowel 162.

Figure 10:
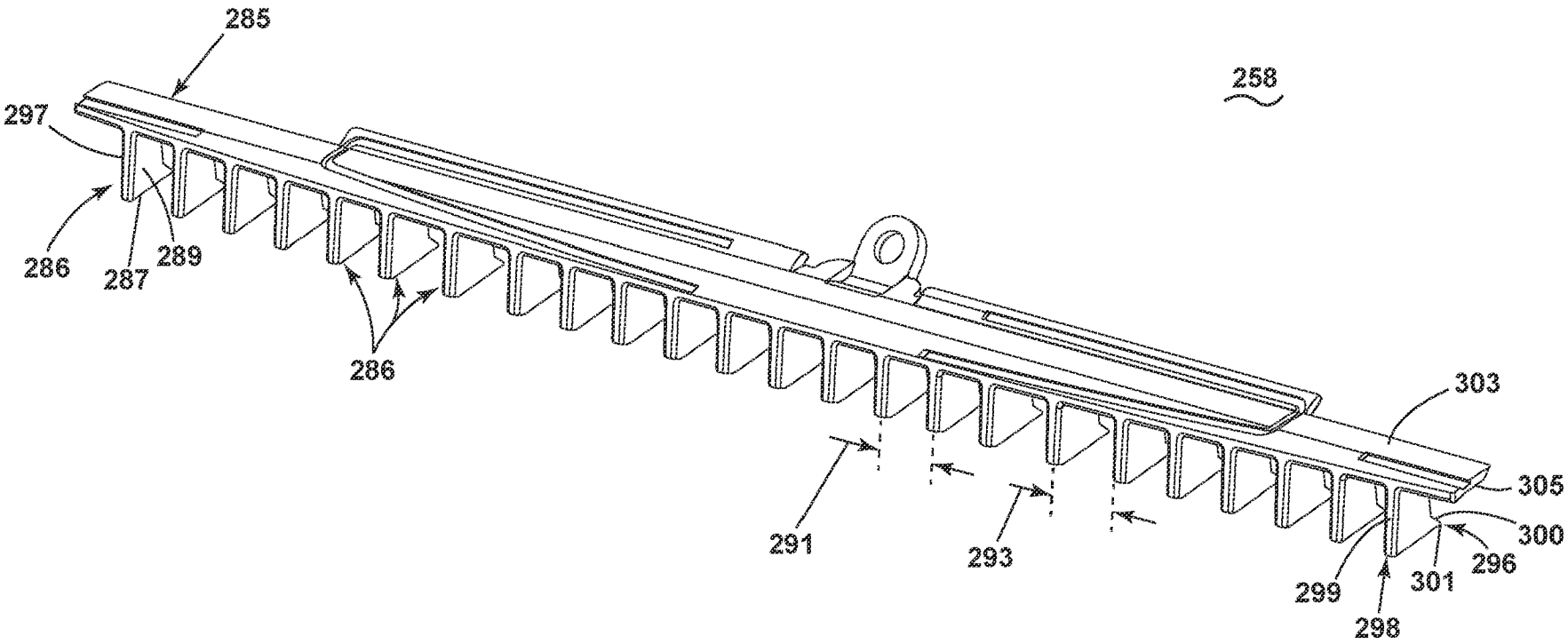
FIG. 10 is a perspective view of another example of a comb assembly for use with the vacuum cleaner of FIG. 1 and FIG. 2 or with the vacuum cleaner of FIG. 8 and FIG. 9.

FIG. 10 illustrates another non-limiting example of a comb assembly 258. The comb assembly 258 is similar to the comb assemblies 58 and 158; therefore, like parts will be identified with like numerals in the 200 series, with it being understood that the description of the like parts of the comb assemblies 58 and 158 applies to the comb assembly 258 unless otherwise noted.

The comb assembly 258 includes a plurality of teeth 286 extending from the surface or wall 285. The wall 285 can include a first surface 303 and a second surface 305, spaced and opposite from the first surface 303. The plurality of teeth 286 may extend from the second surface 305. The plurality of teeth 286 may extend radially inward towards the brushroll 60, 160 once mounted within the appropriate agitation chamber 38, 138. An edge 287 can be defined by a first distal end that is farthest from the first surface 303 of the wall 285. The edge 287 may have any suitable shape including that it be formed as an arc or as a substantially planar edge 287. A first sidewall 289 and second sidewall 297 of each tooth of the plurality of teeth 286 can extend between the wall 285 and the edge 287.

The first and second sidewalls 289, 297 can extend from a leading edge 296 to a trailing edge 298. The leading edge 296 can include at least one serrated, pointed, barbed, tapered, hooked, or otherwise sharpened portion. In the non-limiting illustrated example, the leading edge 296 includes a projection 300. The projection 300 begins at the edge 287 and extends partially up the first sidewall 289. The projection 300 forms a pointed portion 301. The trailing edge 298 can extend between the wall 285 and the edge 287 to form what can be thought of as a trailing wall 299.

A gap distance can be defined as an axial distance between the leading edge 296 of adjacent teeth of the plurality of teeth 286. It will be understood that the gap distance can be the same for each of the adjacent teeth of the plurality of teeth 286. Alternatively, the gap distance can be the different for each of the adjacent teeth of the plurality of teeth 286. Further still, the gap distance may be grouped such that some of the gaps are the same while others are different. As illustrated, by way of example, the gap distance can be the first gap distance 291 and the second gap distance 293, where the second gap distance 293 is different than the first gap distance 291. Further as illustrated, the gap distance or axial distance between adjacent teeth at the leading edge 296 and the trailing edge 298 of the adjacent teeth can be equal or within 5%, such that the adjacent teeth appear straight and parallel with one another from the leading edge 296 to the trailing edge 298. However, it is contemplated that the trailing edge distance (axial distance between adjacent teeth at the trailing edge 298) can be different than the corresponding gap distance (axial distance between adjacent teeth at the leading edge 296).

The plurality of teeth 286 are illustrated as extending generally perpendicular (85-95 degrees) from the wall 285, however it is contemplated that each tooth of the plurality of teeth 286 can extend from the wall 285 at a variety of angles. As illustrated, a trailing wall angle A (FIG. 12), defined as the angle at which the trailing wall 299 extends from the wall 285, can be greater than or equal to 90°. However, it is contemplated that the trailing wall angle A can have any suitable angle that can be the same or different between each tooth of the plurality of teeth 286.

Figure 11:
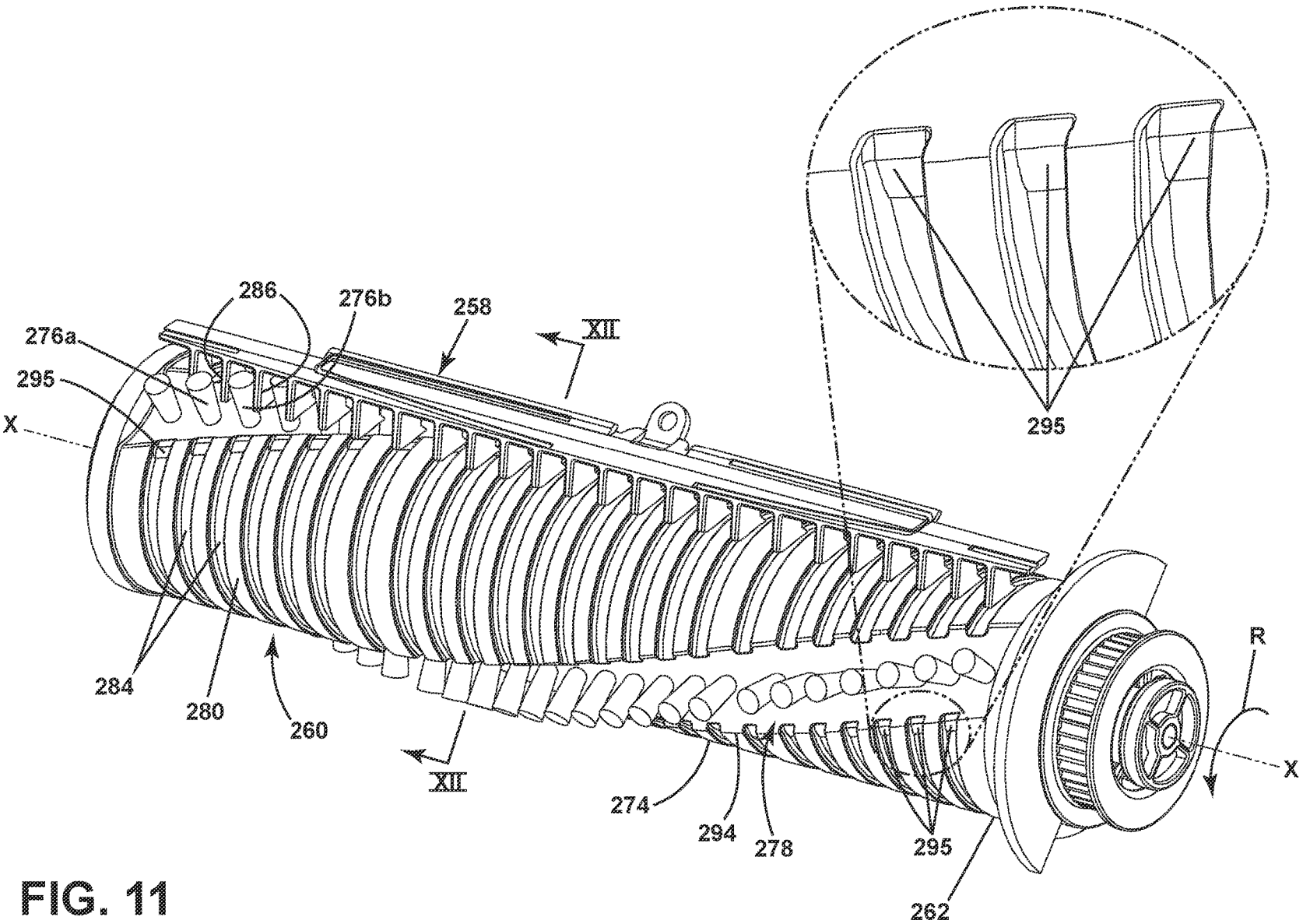
FIG. 11 is a perspective view of the comb assembly of FIG. 10 with another example of a brushroll for use with the vacuum cleaner of FIG. 1 and FIG. 2 or with the vacuum cleaner of FIG. 8 and FIG. 9.

FIG. 11 is a perspective view of the comb assembly 258 with another non-limiting example of a brushroll 260. The brushroll 260 is similar to the brushroll 60 and 160; therefore, like parts will be identified with like numerals in the 200 series, with it being understood that the description of the like parts of the brushroll 60 and 160 applies to the brushroll 260 unless otherwise noted. The comb assembly 258 and brushroll 260 can be used with various vacuum cleaners, including the vacuum cleaner 10 or the autonomous vacuum cleaner 110 described herein. It will also be understood that the comb assembly 258 can be utilized with the brushroll 60 and the brushroll 160, although fit aspects will need to be taken into consideration and adjustments made therefore. For example, depending on bristle 72, 172 placement or brushroll 60, 160 width, the spacing of the plurality of teeth 286 or sizing of the length of the plurality of teeth 286 may need to be taken into consideration.

The brushroll 260 is similar to the brushroll 60, including the brush dowel 262 configured to be mounted for rotation about a central rotational axis X and the brushroll 260 configured to be rotationally driven in the direction indicated by arrow R, with the main difference between the brushroll 60 and the brushroll 260 being that the brushroll 260 includes a plurality of bumps or protuberances 295 provided at the inflection points or outside corners 294 where the shroud surface 274 meets the mounting surface 278. Specifically, the protuberances 295 are provided within the voids or recesses 284 defined by the spacing between the plurality of ribs 280, at the trailing ends of the recesses 284 where the recesses 284 terminate at the mounting surface 278 as the brushroll 260 rotates in the direction R.

The protuberances 295 extend slightly radially outward, away from the central rotational axis X and toward the plurality of teeth 286, such as toward the leading edge 296 of the plurality of teeth 286. In the illustrated example, the protuberances 295 are defined by and formed with the brush dowel 262, such that the protuberances 295 comprise a portion of the brush dowel 262 having a slightly increased thickness or diameter at the positions of the protuberances 295. However, it is also contemplated that the protuberances 295 can be formed separately from the brush dowel 262 as separate, affixable pieces that are fixed to the brush dowel 262. Further by way of non-limiting example, the plurality of protuberances 295 can be formed from material extending from the recesses 284 along the circumference of the brush dowel 262, such that the protuberances 295 can partially circumferentially extend from the recesses 284. However, it will be understood that the protuberances 295 are not limited to extending from the recesses 284 directly, and can be thought of as extending from another surface or structure of the brush dowel 262, so long as at least one of the recesses 284 between the plurality of ribs 280 includes a protuberance 295 positioned within the at least one of the recesses 284 and extending radially outward toward the plurality of teeth 286. In addition, in the illustrated example, the protuberances 295 extend radially outward from the recesses 284 along a portion of the height of the ribs 280, but not as far as the height of the ribs 280. However, it is contemplated that the protuberances 295 can have any suitable height, including having a height the same as the height of the ribs 280.

The plurality of teeth 286 of the comb assembly 258 can radially align with recesses 284 between each of the plurality of ribs 280. It is contemplated that each tooth of the plurality of teeth 286 can pass between two adjacent tufts 276*a*, 276*b* extending from the mounting surface 278. That is, each tooth of the plurality of teeth 286 can align with a gap between two adjacent tufts 276*a*, 276*b* or separate the two adjacent tufts 276*a*, 276*b* as the two adjacent tufts 276*a*, 276*b* rotate through the comb assembly 258. However, it can equally be contemplated that some of the plurality of teeth 286 are aligned to pass through portions of the tufts 276 in alternative aspects.

Figure 12:
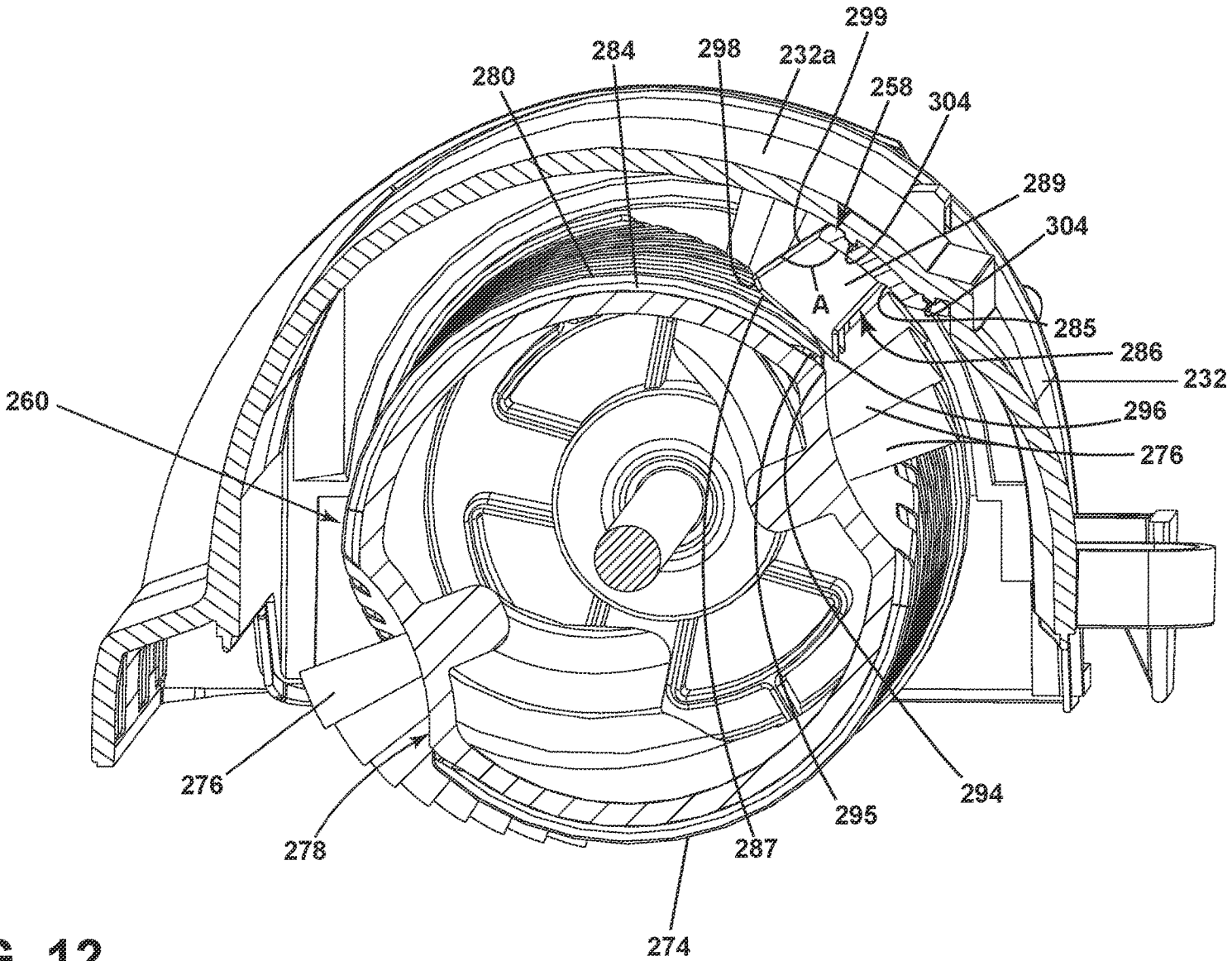
FIG. 12 is a perspective cross-sectional view of the brushroll and the comb assembly of FIG. 11 taken through line XII-XII of FIG. 11 and also including a portion of an upper housing of the base.

FIG. 12 is a perspective view of a cross section of the brushroll 260 and the comb assembly 258 of FIG. 11 taken through line XII-XII of FIG. 11, and also including another non-limiting example of a portion 232*a* of an upper housing 232 to show attachment of the comb assembly 258. The portion 232*a* of the upper housing 232 is similar to the portion 32*a* of the upper housing 32; therefore, like parts will be identified with like numerals in the 200 series, with it being understood that the description of the like parts of the portion 32*a* of the upper housing 32 applies to the portion 232*a* of the upper housing 232 unless otherwise noted. By way of non-limiting example, the portion 232*a* of the upper housing 232 can be at least partially formed of a material that is transparent or at least partially transparent, such that at least a portion of the comb assembly 258 and the brushroll 260 can be seen by a user through the transparent material of the portion 232*a* of the upper housing 232. In a further non-limiting example, the portion 232*a* of the upper housing 232 is configured for attachment with the comb assembly 258.

Turning now to the attachment of the comb assembly 258, optionally, at least one mounting structure 304 can be formed with or attached to the first surface 303 of the wall 285 of the comb assembly 258. The at least one mounting structure 304 can fixedly or removably mount the comb assembly 258 to one or more portions of the base 14, the lower housing 34, the upper housing 32, or the upper housing 232, illustrated herein as being mounted to the portion 232*a* of the upper housing 232. The comb assembly 258 can be removed from the agitator chamber 38 (see FIG. 2) to sharpen one or more surfaces of the plurality of teeth 286 or to be replaced with a new comb assembly 258. In one non-limiting example, the comb assembly 258 is mounted to the portion 232*a* of the upper housing 232 by welding, such as by sonic welding fixation, at the mounting structures 304. However, it will be understood that such attachment method is not limiting and that a variety of suitable attachment methods or mechanisms can be used, including removable or reversible attachments. By way of further non-limiting example, such attachment methods or mechanisms can include any mechanical or magnetic coupling, the at least one mounting structure 304 including an eyelet that receives a fastener such as, but not limited to, a screw, the at least one mounting structure 304 being a latching mechanism that can, for example, snap into a portion of the portion 232*a* of the upper housing 232 or rotate to engage the portion 232*a*, or the at least one mounting structure 304 being an alignment structure for proper alignment with the portion 232*a* of the upper housing 232.

The comb assembly 258 partially circumscribes or forms an arc about a portion of the brushroll 260. That is, the wall 285 circumscribes at least a portion of the brushroll 260. The plurality of teeth 286 extend radially inward from the wall 285 toward the brushroll 260. The plurality of teeth 286 are received by the recesses 284 defined between adjacent ribs of the plurality of ribs 280 (see FIG. 11). The cross section can be considered to be taken at one of the recesses 284 with the adjacent rib 280 shown.

The inclusion of the protuberances 295 within the recesses 284 receiving the plurality of teeth 286 reduces the clearance between the leading edge 296 of the teeth 286 and the recesses 284 at the protuberances 295 as compared to the clearance between the leading edge 296 of the teeth 286 and the recesses 284 where the protuberances 295 are not included. By way of non-limiting example, it is contemplated that the gap between the leading edge 296 of the teeth 286 and the protuberances 295 when the leading edge 296 and the protuberance 295 are aligned can be reduced from approximately 0.75 millimeters without the protuberance 295 to approximately 0.5 millimeters with the protuberance 295. By minimizing this gap as much as possible, the leading edges 296 of the teeth 286 are able to contact and catch a maximal amount of debris to be removed from the brushroll 260. Additionally, by controlling the size of the gap by the size and inclusion of the protuberances 295 on the brush dowel 262, the clearance to the teeth 286 can be more easily adjusted by changing the protuberances 295 than by changing the teeth 286 or the comb assembly 258. The protuberances 295 are provided at the outside corners 294 where the convex curved surfaces defining the shroud surface 274 intersect the concave curved sections defining the mounting surfaces 278. The outside corners 294 forming the protuberances 295 can be rounded, curved, or sharp corners. By providing the protuberances 295 specifically at the outside corners 294 before the mounting surfaces 278 for the bristle tufts 276, it is ensured that the leading edges 296 of the teeth 286 catch the maximal amount of debris for removal from the brushroll 260 at the point where most of the debris may be entangled with the brushroll 260, at the bristle tufts 276.

Benefits of the disclosure include the combination of several hair wrapping elements including at least the shroud surface and the comb assembly.

When the brush dowel includes the protuberances provided within the recesses for receiving the teeth of the comb assembly, the clearance or gap between the leading edge of the teeth and the protuberances is reduced, compared to when the protuberances are not included, ensuring that the comb assembly can cut or pull hair or other debris as close to the surfaces of the brush dowel as possible.

The comb assembly can cut or pull hair or other debris from the bristles. Once cut or pulled away from the bristles, the suction system can pull the hair or other debris into the working air flow. Further, the trailing wall angle at which the trailing wall of the teeth extend from the wall can be selected to optimize buildup of debris and for visual appeal. For example, when the trailing wall angle is an obtuse angle greater than 90°, the buildup of debris between the comb assembly and the upper housing can be reduced, as compared to when the trailing wall angle is an acute angle less than 90°. Further, when the trailing wall angle is an obtuse angle greater than 90°, the comb assembly can catch the light in a way that can be more visually appealing to a user, such as in the case that the comb assembly is visible through the transparent brushroll window of the autonomous vacuum cleaner, or when the upper housing, or at least a portion of the upper housing, of the vacuum cleaner is transparent.

To the extent not already described, the different features and structures of the various aspects can be used in combination with each other as desired. That one feature may not be illustrated in all of the aspects is not meant to be construed that it cannot be, but is done for brevity of description. Thus, the various features of the different aspects can be mixed and matched as desired to form new aspects, whether or not the new aspects are expressly described. All combinations or permutations of features described herein are covered by this disclosure. For example, it will be understood that the comb assembly 258 can be provided with any of the brushrolls 60, 160, 260, and that the brushroll 260 can also be provided in combination with the comb assemblies 58, 158.

For example, various characteristics, aspects, and advantages of the present invention may also be embodied in the following technical solutions defined by the following clauses and may include any combination of the following concepts:

A vacuum cleaner, comprising a base comprising an agitator chamber and a suction nozzle opening in fluid communication with the agitator chamber, a brushroll positioned within the agitator chamber for rotational movement, the brushroll comprising a brush dowel having a plurality of ribs and provided with a plurality of bristles, and a comb assembly provided within the agitator chamber, the comb assembly circumscribing at least a portion of the brushroll and comprising a plurality of teeth that radially extend between a portion of the ribs of the brushroll.

The vacuum cleaner of any preceding clause, wherein the plurality of bristles form a plurality of discrete tufts along at least a portion of a length of the brush dowel, and further wherein the plurality of discrete tufts form a plurality of bristle rows along the at least a portion of the length.

The vacuum cleaner of any preceding clause, wherein the plurality of bristle rows extend in a helical pattern around a circumference of the brush dowel.

The vacuum cleaner of any preceding clause, wherein the plurality of ribs define recesses between adjacent ribs.

The vacuum cleaner of any preceding clause, wherein the plurality of teeth include a leading edge, and further wherein a portion of the leading edge of the plurality of teeth is received by the recesses between the plurality of ribs.

The vacuum cleaner of any preceding clause, wherein at least one of the recesses between the plurality of ribs includes a protuberance extending radially outward toward the leading edge of the plurality of teeth.

The vacuum cleaner of any preceding clause, wherein a portion of a leading edge of the plurality of teeth is received by recesses between the plurality of ribs.

The vacuum cleaner of any preceding clause, wherein at least one of the recesses between the plurality of ribs includes a protuberance extending radially outwardly toward the leading edge of the plurality of teeth.

The vacuum cleaner of any preceding clause, wherein the plurality of teeth extend from a leading edge to a trailing edge and the leading edge of the plurality of teeth includes a sharpened edge.

The vacuum cleaner of any preceding clause, wherein a radial width of the plurality of teeth decreases as the plurality of teeth extend from the leading edge to the trailing edge or wherein the sharpened edge is a plurality of sharpened edges arranged in a saw-tooth or sinusoidal pattern.

The vacuum cleaner of any preceding clause, wherein the comb assembly includes at least one mounting structure to removably mount the comb assembly to the base.

The vacuum cleaner of any preceding clause, wherein the vacuum cleaner is one of an upright-type vacuum cleaner, a canister-type vacuum cleaner, a stick vacuum cleaner, an autonomous vacuum cleaner, or a hand-held vacuum cleaner.

The vacuum cleaner of any preceding clause, wherein the plurality of bristles define a trim diameter and the brush dowel defines a major diameter, wherein the trim diameter is greater than the major diameter.

The vacuum cleaner of any preceding clause, wherein the plurality of teeth extend from a leading edge to a trailing edge and the leading edge of the plurality of teeth includes a projection.

The vacuum cleaner of any preceding clause, wherein the projection extends partially up the teeth from the leading edge and forms a pointed portion.

The vacuum cleaner of any preceding clause, wherein the brush dowel further comprises a shroud surface and a mounting surface and the plurality of bristles are mounted at the mounting surface and the plurality of ribs are located at the shroud surface.

The vacuum cleaner of any preceding clause, wherein the mounting surface defines a channel that extends axially along the brush dowel adjacent to one or more bristle supports.

The vacuum cleaner of any preceding clause, wherein the plurality of bristles mounted at the mounting surface of the brush dowel further comprise the one or more bristle supports having bristle support platforms projecting from the mounting surface into a hollow interior of the brush dowel.

The vacuum cleaner of any preceding clause, wherein the bristle support platforms include bristle holes extend at least partially into the bristle support platforms that receive the plurality of bristles as tufts.

The vacuum cleaner of any preceding clause, wherein at least a subset of the bristle holes axially align with a rib from the plurality of ribs and as the brushroll rotates, the plurality of teeth pass between the tufts mounted in the subset of the bristle holes.

An agitator assembly for a surface cleaner, the agitator assembly comprising a housing at least partially defining an agitator chamber and a suction nozzle opening in fluid communication with the agitator chamber, a brushroll positioned within the agitator chamber for rotational movement, the brushroll comprising a brush dowel having a plurality of ribs and provided with a plurality of bristles, and a comb assembly provided within the agitator chamber, the comb assembly circumscribing at least a portion of the brushroll and comprising a plurality of teeth that radially extend between a portion of the ribs of the brushroll.

The agitator assembly of any preceding clause, wherein the plurality of ribs define recesses between adjacent ribs and the plurality of teeth include a leading edge, and further wherein a portion of the leading edge of the plurality of teeth is received by the recesses between the plurality of ribs and at least one of the recesses between the plurality of ribs includes a protuberance extending radially outward toward the leading edge of the plurality of teeth.

The agitator assembly of any preceding clause, wherein the plurality of teeth extend from a leading edge to a trailing edge and the leading edge of the plurality of teeth includes a sharpened edge.

The agitator assembly of any preceding clause, wherein a radial width of the plurality of teeth decreases as the plurality of teeth extend from the leading edge to the trailing edge and/or wherein the sharpened edge is a plurality of sharpened edges arranged in a saw-tooth or sinusoidal pattern.

The agitator assembly of any preceding clause, wherein the comb assembly includes at least one mounting structure to removably mount the comb assembly to the housing.

The agitator assembly of any preceding clause, wherein the plurality of teeth extend from a leading edge to a trailing edge and the leading edge of the plurality of teeth includes a projection extending partially up the plurality of teeth from the leading edge and forming a pointed portion.

The agitator assembly of any preceding clause, wherein the brush dowel further comprises a shroud surface, wherein the plurality of ribs are located at the shroud surface, and a mounting surface defining a channel that extends axially along the brush dowel adjacent to one or more bristle supports, wherein the plurality of bristles are mounted at the mounting surface and further comprise the one or more bristle supports having bristle support platforms projecting from the mounting surface into a hollow interior of the brush dowel and including bristle holes extending at least partially into the bristle support platforms that receive the plurality of bristles as tufts, and further wherein at least a subset of the bristle holes axially align with a rib from the plurality of ribs and as the brushroll rotates, the plurality of teeth pass between the tufts mounted in the subset of the bristle holes.

While aspects of the present disclosure have been specifically described in connection with certain specific aspects thereof, it is to be understood that this is by way of illustration and not of limitation. Reasonable variation and modification are possible with the scope of the foregoing disclosure and drawings without departing from the spirit of the present disclosure which, is defined in the appended claims. Hence, specific dimensions and other physical characteristics relating to the aspects disclosed herein are not to be considered as limiting, unless the claims expressly state otherwise.

What is claimed is:

1. A vacuum cleaner, comprising:

a base comprising an agitator chamber and a suction nozzle opening in fluid communication with the agitator chamber;

a brushroll positioned within the agitator chamber for rotational movement, the brushroll comprising a brush dowel having a plurality of ribs and provided with a plurality of bristles; and a comb assembly provided within the agitator chamber, the comb assembly circumscribing at least a portion of the brushroll and comprising a plurality of teeth that radially extend between a portion of the ribs of the brushroll, wherein the plurality of teeth extend from a leading edge to a trailing edge;

wherein the plurality of ribs define recesses between adjacent ribs;

wherein a portion of the leading edge of the plurality of teeth is received by the recesses between the plurality of ribs; and wherein at least one of the recesses between the plurality of ribs includes a protuberance extending radially outward toward the leading edge of the plurality of teeth.

2. The vacuum cleaner of claim 1, wherein the leading edge of the plurality of teeth includes a sharpened edge; and wherein a radial width of the plurality of teeth decreases as the plurality of teeth extend from the leading edge to the trailing edge or wherein the sharpened edge is a plurality of sharpened edges arranged in a saw-tooth or sinusoidal pattern.

3. The vacuum cleaner of claim 1, wherein the comb assembly includes at least one mounting structure to removably mount the comb assembly to the base.

4. The vacuum cleaner of claim 1, wherein the vacuum cleaner is one of an upright-type vacuum cleaner, a canister-type vacuum cleaner, a stick vacuum cleaner, an autonomous vacuum cleaner, or a hand-held vacuum cleaner.

5. The vacuum cleaner of claim 1, wherein the leading edge of the plurality of teeth includes a projection.

6. The vacuum cleaner of claim 5, wherein the projection extends partially up the plurality of teeth from the leading edge and forms a pointed portion.

7. A vacuum cleaner, comprising:

a base comprising an agitator chamber and a suction nozzle opening in fluid communication with the agitator chamber;

a brushroll positioned within the agitator chamber for rotational movement, the brushroll comprising a brush dowel having a shroud surface, a mounting surface defining a channel that extends axially along the brush dowel adjacent to one or more bristle supports, a plurality of ribs, and a plurality of bristles mounted at the mounting surface, wherein the plurality of bristles comprise the one or more bristle supports having bristle support platforms projecting from the mounting surface into a hollow interior of the brush dowel and including bristle holes extending at least partially into the bristle support platforms that receive the plurality of bristles as tufts, and the plurality of ribs are located at the shroud surface; and a comb assembly provided within the agitator chamber, the comb assembly circumscribing at least a portion of the brushroll and comprising a plurality of teeth that radially extend between a portion of the ribs of the brushroll.

8. The vacuum cleaner of claim 7, wherein the plurality of ribs define recesses between adjacent ribs.

9. The vacuum cleaner of claim 8, wherein a portion of a leading edge of the plurality of teeth is received by the recesses between the plurality of ribs.

10. The vacuum cleaner of claim 9, wherein at least one of the recesses between the plurality of ribs includes a protuberance extending radially outward toward the leading edge of the plurality of teeth.

11. The vacuum cleaner of claim 7, wherein at least a subset of the bristle holes axially align with a rib from the plurality of ribs and as the brushroll rotates, the plurality of teeth pass between the tufts mounted in the subset of the bristle holes.

12. An agitator assembly for a surface cleaner, the agitator assembly comprising:

a housing at least partially defining an agitator chamber and a suction nozzle opening in fluid communication with the agitator chamber;

a brushroll positioned within the agitator chamber for rotational movement, the brushroll comprising a brush dowel having a plurality of ribs and provided with a plurality of bristles; and a comb assembly provided within the agitator chamber, the comb assembly circumscribing at least a portion of the brushroll and comprising a plurality of teeth that radially extend between a portion of the ribs of the brushroll, wherein the plurality of ribs define recesses between adjacent ribs and the plurality of teeth include a leading edge, and wherein a portion of the leading edge of the plurality of teeth is received by the recesses between the plurality of ribs and at least one of the recesses between the plurality of ribs includes a protuberance extending radially outward toward the leading edge of the plurality of teeth.

13. The agitator assembly of claim 12, wherein the plurality of teeth extend from a leading edge to a trailing edge and the leading edge of the plurality of teeth includes a sharpened edge.

14. The agitator assembly of claim 13, wherein a radial width of the plurality of teeth decreases as the plurality of teeth extend from the leading edge to the trailing edge and/or wherein the sharpened edge is a plurality of sharpened edges arranged in a saw-tooth or sinusoidal pattern.

15. The agitator assembly of claim 12, wherein the comb assembly includes at least one mounting structure to removably mount the comb assembly to the housing.

16. The agitator assembly of claim 12, wherein the plurality of teeth extend from a leading edge to a trailing edge and the leading edge of the plurality of teeth includes a projection extending partially up the plurality of teeth from the leading edge and forming a pointed portion.

17. The agitator assembly of claim 12, wherein the brush dowel further comprises:

a shroud surface, wherein the plurality of ribs are located at the shroud surface; and a mounting surface defining a channel that extends axially along the brush dowel adjacent to one or more bristle supports, wherein the plurality of bristles are mounted at the mounting surface and further comprise the one or more bristle supports having bristle support platforms projecting from the mounting surface into a hollow interior of the brush dowel and including bristle holes extending at least partially into the bristle support platforms that receive the plurality of bristles as tufts, and further wherein at least a subset of the bristle holes axially align with a rib from the plurality of ribs and as the brushroll rotates, the plurality of teeth pass between the tufts mounted in the subset of the bristle holes.

* * * * *